United States Patent [19]

Nakamura et al.

[11] Patent Number: 4,797,088

[45] Date of Patent: Jan. 10, 1989

[54] SAFETY DEVICE FOR OIL BURNER

[75] Inventors: Kazuharu Nakamura, Aichi; Yoshio Mito, Gifu; Yutaka Nakanishi, Aichi; Toshihiko Yamada, Aichi; Yuji Sanada, Aichi, all of Japan

[73] Assignee: Toyotomi Kogyo Co., Ltd., Aichi, Japan

[21] Appl. No.: 857,013

[22] Filed: Apr. 29, 1986

[30] Foreign Application Priority Data

Apr. 30, 1985 [JP] Japan ..... 60-93445
Nov. 12, 1985 [JP] Japan ..... 60-254513

[51] Int. Cl.[4] ..... F23N 5/24

[52] U.S. Cl. ..... 431/15; 431/33; 431/34; 431/88

[58] Field of Search ..... 431/15, 22, 33, 34, 431/79

[56] References Cited

U.S. PATENT DOCUMENTS 2,074,637 3/1937 Ballentine .
2,640,920 6/1953 Cairns, Jr. .
3,301,307 1/1967 Nishigaki et al. .
4,561,840 12/1985 Nakamura et al. .

FOREIGN PATENT DOCUMENTS 37628 3/1982 Japan ..... 431/33
908973 10/1962 United Kingdom ..... 431/33

*Primary Examiner*—Carroll B. Dority, Jr.
*Attorney, Agent, or Firm*—Pollock, Vande Sande and Priddy

[57] ABSTRACT

A safety device for an oil burner is disclosed which is capable of detecting abnormal combustion which forms an excessively decreased flame, for example, sufficient to produce incomplete combustion gas to operate a fire-extinguishing device of the oil burner. The safety device includes an abnormal combustion sensing and actuation mechanism which is adapted to receive heat rays from the oil burner to detect the abnormal combustion and a starting member selectively actuated by the mechanism to operate the fire-extinguishing device when the mechanism detects the abnormal combustion.

35 Claims, 8 Drawing Sheets

SAFETY DEVICE FOR OIL BURNER

BACKGROUND OF THE INVENTION

1. Field of the Invention

This invention relates to a safety device for an oil burner such as an oil-fired space heater, and more particularly to a safety device for an oil burner which is adapted to detect abnormal combustion of fuel oil in the oil burner which forms, in particular, an abnormally decreased flame sufficient to produce incomplete combustion gas.

2. Description of the Prior Art

An oil burner generally has an automatic fire-extinguishing device incorporated therein which serves to rapidly stop combustion of fuel oil in the oil burner when any emergency such as earthquake or the like occurs. Such a fire-extinguishing device is typically activated depending upon an abnormal variation in a combustion temperature of the oil burner detected by means of bimetal or shape memory alloy to carry out fire-extinguishing of the oil burner prior to the abnormal combustion of the oil burner.

Abnormal combustion includes excessively increased combustion which forms an abnormally large flame and excessively decreased combustion which forms an abnormally small flame. The latter abnormal combustion generally is apt to cause a large amount of incomplete combustion gas, accordingly, it is highly desirable to start an automatic fire-extinguishing device prior to the abnormal combustion.

The stopping of the excessively decreased combustion by detecting a combustion temperature of the oil burner as in the excessively increased combustion requires the detection of a decrease in a temperature of the oil burner from the stationary combustion to the abnormal combustion. However, this undesirably detects a low temperature of the oil burner immediately after the ignition as well, to thereby fail to effectively start combustion of the oil burner.

Also, the detection of abnormal combustion in the oil burner requires a temperature sensor or detector to be arranged in proximity to a combustion cylinder of the oil burner. This causes the mechanical and electrical connection between the temperature detector and the fire-extinguishing device to be highly complicated, because the combustion cylinder must be constructed to be operated manually as well as automatically at the time of ignition of the oil burner.

SUMMARY OF THE INVENTION

The present invention has been made in view of the foregoing disadvantage of the prior art.

Accordingly, it is an object of the present invention to provide a safety device for an oil burner which is capable of effectively detecting abnormal combustion which forms an excessively decreased flame, for example sufficient to produce incomplete combustion gas, to thereby carry out the fire-extinguishing of the oil burner at the abnormal combustion.

It is another object of the present invention to provide a safety device for an oil burner which is capable of detecting abnormal combustion forming an excessively decreased flame without adversely affecting ignition of the oil burner.

It is a further object of the present invention to provide a safety device for an oil burner which is capable of ensuring its positive operation at the time of abnormal combustion of the oil burner which forms an excessively decreased flame.

It is still another object of the present invention to provide a safety device for an oil burner which is capable of effectively detecting not only abnormal combustion forming an excessively decreased flame but that forming an excessively increased flame which is in danger of, for example, overheating of the oil burner and/or a fire.

It is still a further object of the present invention to provide a safety device for an oil burner which is capable of effectively accomplishing the above-described object with simple structure and operation.

Briefly speaking, in accordance with the present invention, a safety device for an oil burner is provided which includes an abnormal combustion sensing and actuation mechanism. The mechanism is adapted to detect abnormal combustion in an oil burner which forms an excessively or abnormally decreased flame, for example, sufficient to produce incomplete combustion gas such as carbon monoxide or the like. The abnormal combustion sensing and actuation mechanism may be constructed in a manner to receive heat rays emitted from a combustion cylinder construction of the oil burner and carry out its mechanical actuation when it detects the abnormal combustion due to a variation in a temperature of the combustion cylinder construction. Alternatively, it may be constructed so as to electrically detect the abnormal combustion due to a variation in heat rays emitted from the combustion cylinder construction. In the latter case, the abnormal combustion sensing and actuation mechanism may also include a means for detecting abnormal combustion which forms an excessively or abnormally increased flame which is in danger of, for example, overheating of the oil burner.

The safety device according to the present invention also includes a starting means for starting a fire-extinguishing device of the oil burner. The starting means is operatedly connected to the abnormal combustion sensing and actuation mechanism so as to be actuated to operate the fire-extinguishing device when the abnormal combustion sensing and actuation mechanism detects the abnormal combustion in the oil burner. The starting means may be constructed either mechanically or electrically.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein'

FIGS. 3A to 3D each a schematic view showing the manner of operation of the safety device shown in FIG. 1, wherein FIG. 3A shows the positional relationship between a projection and an actuation member upon completion of fire-extinguishing and at the time of ignition, FIG. 3B shows the positional relationship therebetween for a period of time during which a temperature of an oil burner is increased, FIG. 3C shows the relationship therebetween during the combustion operation and FIG. 3D shows the relationship therebetween for a period of time during which a temperature of the oil burner is decreased;

DETAILED DESCRIPTION OF THE PREFERRED EMBODIMENTS

Now, a safety device for an oil burner according to the present invention will be described hereinafter with reference to the accompanying drawings.

Figure 1:
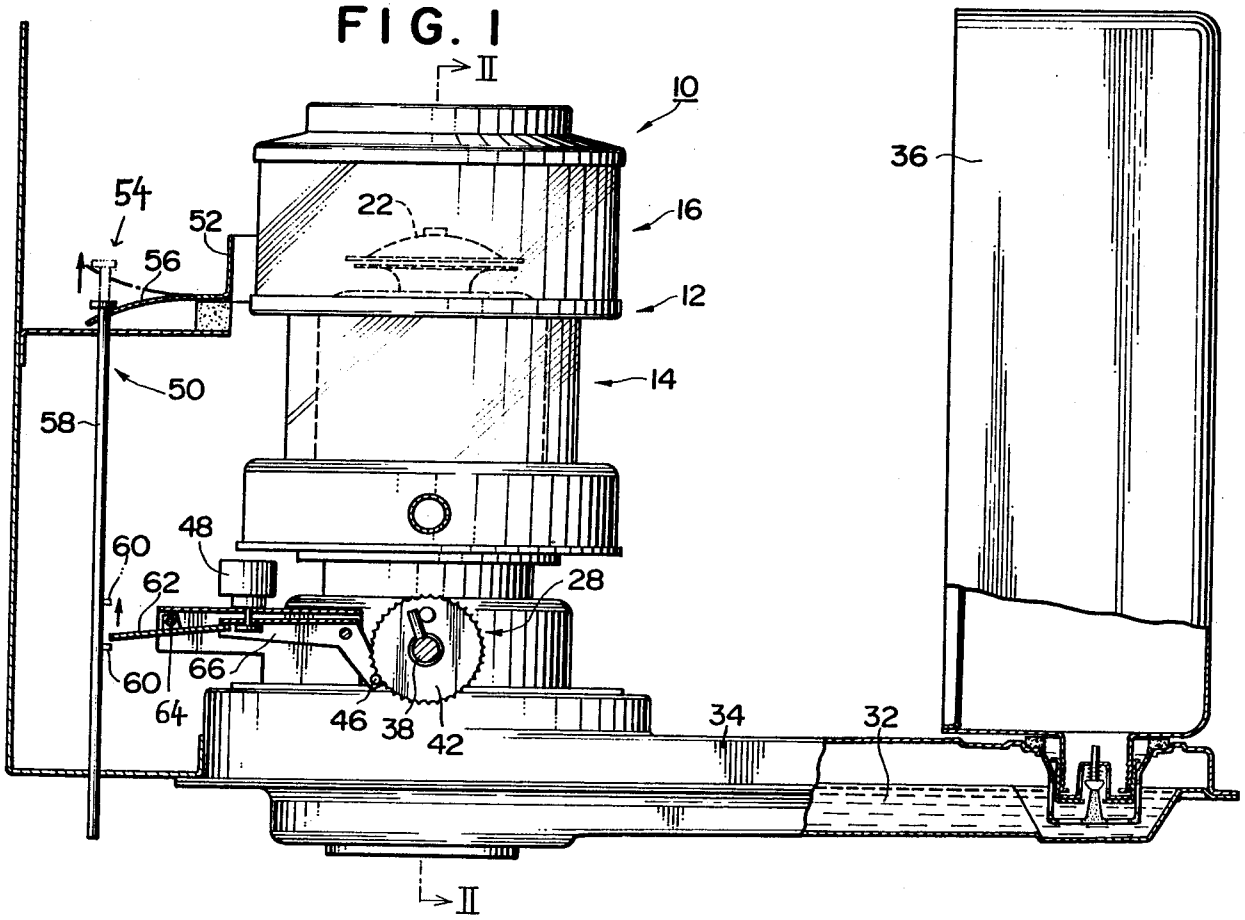
FIG. 1 is a front elevation view partly in section showing an embodiment of a safety device for an oil burner according to the present invention and an example of an oil burner to which the embodiment is adapted to applied.
Figure 2:
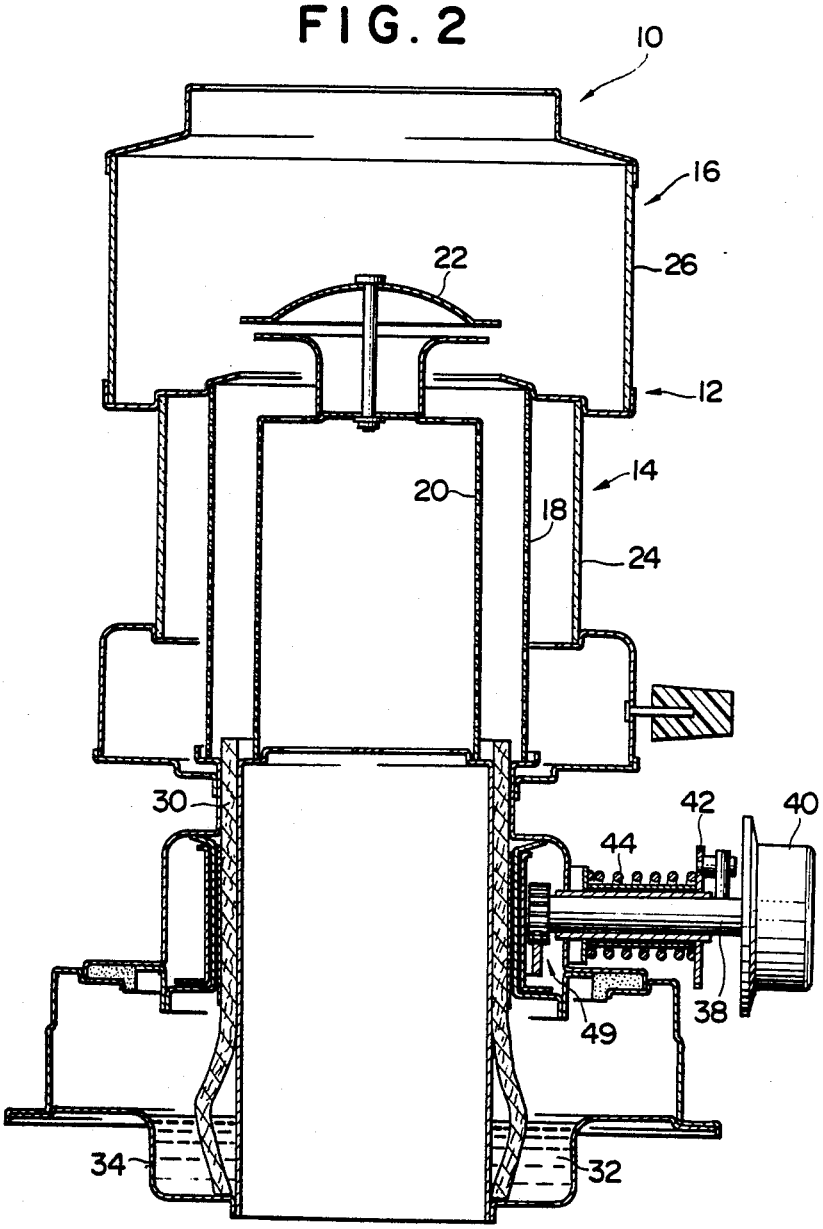
FIG. 2 is a vertical sectional view taken along line II—II of FIG. 1.

FIG. 1 shows an embodiment of a safety device for an oil burner according to the present invention. An oil burner in which a safety device of the present invention is adapted to be incorporated is generally designated by reference numeral 10 and may be constructed in such a manner as widely known in the art. The oil burner 10 is of the wick ignition type and includes a combustion cylinder construction 12 comprising a red-heated cylinder section 14 and a flame spreading section 16 in which a white-yellow flame is formed. The red-heated section 14, as shown in FIG. 2, includes a perforated outer cylindrical member 18 and a perforated inner cylindrical member 20 and is adapted to carry out combustion of fuel oil vaporized from a wick. The flame spreading section 16 includes a flame spreader 22 which serves to burn incomplete combustion gas and unburned fuel oil gas remaining in combustion gas formed in the red-heated cylinder section 14 to form a long white-yellow flame. The red-heated cylinder section 14 and flame spreading section 16 are adapted to emit heat rays therefrom through heat-permeable cylinder 24 and 26 to the exterior of the oil burner 10 to heat a room, respectively. The red-heated cylinder section 14 may be so constructed that the outer cylindrical member 18 is covered with porcelin enamel and the inner combustion cylinder 20 is provided with a top plate or red-heated hemispherical wire-mesh member which is red-heated to emit heat rays therefrom.

The oil burner 10 also includes an automatic fire-extinguishing device 28 disposed below the combustion cylinder construction 12. The oil burner 10 illustrated in FIGS. 1 and 2 is the wick-ignition type wherein a wick 30 is constantly dipped at a lower portion thereof in fuel oil 32 such as kerosene received in an oil reservoir 34 communicated with an oil tank 36 invertedly supported on the reservoir 34 and adapted to be raised at an upper end thereof into the combustion cylinder construction 12 when the combustion is to be carried out.

The fire-extinguishing device 28 is adapted to forcedly lower the wick 30 at the time of fire-extinguishing. The fire-extinguishing device 28, as shown in FIG. 2, includes a wick operating shaft 38 having a knob 40 provided at one end thereof and a gear 42 freely fitted on the wick operating shaft 38. The device 28 also includes a return spring 44 interposed between a burner body and the gear 42 and a stopper 46 (FIG. 1) which is adapted to be engaged with the gear 42 to stop rotation of the gear, to thereby cause the spring 44 wound up when the wick operating shaft 38 is rotated in the direction of raising the wick 30 to be kept at a wound-up state. The automatic fire-extinguishing device 28 further includes a vibration sensing weight 48 which is connected to the stopper 46 and serves to disengage the stopper 46 from the gear 42 when it falls down due to shock such as earthquake, so that the wick operating shaft 38 may be rotated in the opposite direction due to the force of the wound-up spring 44 to lower the wick 30, to thereby accomplish the fire-extinguishing. The connection of the fire-extinguishing device 28 to the wick 30 may be carried out utilizing a pinion-rack mechanism 49.

The above-described construction of the fire-extinguishing device 28 is widely known in the art, as seen from U.S. Pat. No. 4,498,862 issued to Nakamura et al on Feb. 12, 1985 and assigned to the same assignee as in the present invention.

A safety device for an oil burner of the embodiment shown in FIG. 1 is adapted to be used for, for example, such an oil burner as described above and generally designated by reference numeral 50. The safety device 50 of the illustrated embodiment may include a heat collecting means 52 arranged to receive heat emitted from the combustion cylinder construction 12. In the illustrated embodiment, the heat collecting means 52 comprises a plate member formed of a metal material and arranged laterally opposite to the combustion cylinder construction 12. The safety device 50 also includes an abnormal combustion sensing and actuation mechanism 54 adapted to be in response to a variation in a temperature of the combustion cylinder construction 12. In the embodiment shown in FIG. 1, the mechanism 54 includes a movable means which is adapted to be moved due to a variation in a temperature of the combustion cylinder construction 12 and may be mechanically and thermally connected to the heat collecting plate 52. More particularly, the movable means comprises a thermally deformable element 56 formed of a material deformed depending upon a variation in temperature such as bimetal or shape memory alloy and mechanically and thermally connected to the heat collecting plate 52 and a movable member 58 attached to the deformable element 56 so as to downwardly extend therefrom. The movable member 58 is provided at a suitable portion thereof with an engagement means 60 which, in the illustrated embodiment, comprises a projection.

The abnormal combustion sensing and actuation mechanism 54 further includes an actuation means 62 which is operatedly connected to the movable member 58 which is selectively actuated due to the movement of the movable member 58. In the illustrated embodiment, the actuation means 62 comprises an actuation member which is pivotally mounted on a body of the oil burner 10 through a pin 64, so that it may be vertically pivotally moved about the pin 64 when the movable member 58 actuates it through the projection 60.

The safety device of the illustrated embodiment also includes a starting means 66 operatedly connected in a manner to be selectively operated by the actuation member 62 to start the fire-extinguishing device 28 as described hereinafter when abnormal combustion forming an excessively decreased flame occurs. In the illustrated embodiment, the starting means 66 comprises an extension of the stopper 46 of the fire-extinguishing device 28. Thus, it will be noted that the actuation member 62 is interposedly arranged between the movable member 58 and the starting means 66, so that it may be selectively engaged with the projection 60 of the movable member 58 to actuate the starting means 34 when the vertically extending movable member 58 is vertically moved.

In the illustrated embodiment, the projection 60 is adapted to be positioned below the actuation member 62 when the oil burner does not carry out combustion operation. Then, when the combustion of the oil burner starts and proceeds, the projection 60 is gradually upwardly moved with the movement of the movable member 58 as indicated by an arrow in FIG. 1 due to the deformation of the deformable member 56, during which the projection 60 abutts against the actuation member 62 to lift it. During the combustion operation of the oil burner, the projection 60 is held at a position above the actuation member 62 as indicated by dotted lines in FIG. 1. Also, when a temperature of the combustion cylinder construction 12 of the oil burner 10 is decreased, the projection 60 is lowered with the lowering of the movable member 58 to pivotally move the actuation member 62 about the pin 64 in the counterclockwise direction to actuate the starting means 66, resulting in the fire-extinguishing device 22 being started, and then positioned below the actuation member 62.

Figure 3A:
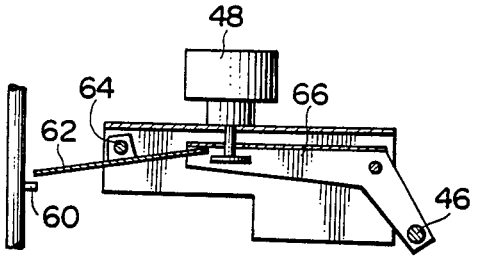
Figure 3B:
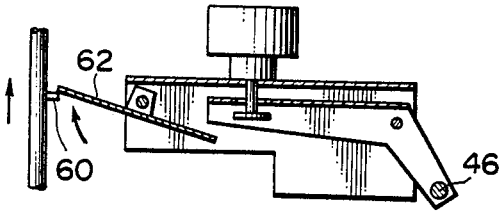

After the fire-extinguishing is completed, the projection 60 of the movable member 58 is further lowered because the thermally deformable element 56 is further cooled to a room temperature. When the combustion operation of the oil burner is to be carried out again, the safety device of illustrated embodiment is adapted not to actuate the fire-extinguishing device 22, even when the projection 60 is lowered below the actuation member 62. More particularly, when the projection 60 of the movable member 58 is lowered to a low temperature position below the actuation member 68, the actuation member 62, as shown in FIG. 3A, is pivotally moved about the pin 64 in the direction separated from the projection 60 in arcs, so that it may be released from the projection 60.

Now, the manner of operation of the safety device of the embodiment described above will be described with reference to FIGS. 1 to 3.

First, the manner of operation from the ignition to the manual fire-extinguishing will be described.

When the wick operating shaft 38 is rotated in the direction of raising the wick 30, it is raised to such a position as shown in FIG. 2 by means of the pinion-rack mechanism 49. At this time, the gear 42 is rotated with the rotation of the wick operating shaft 38 to wind up the return spring 44, which is then kept at a wound-up state by the engagement of the gear 42 with the stopper 46. Thus, the wick 30 is ready to be ignited.

Figure 3C:
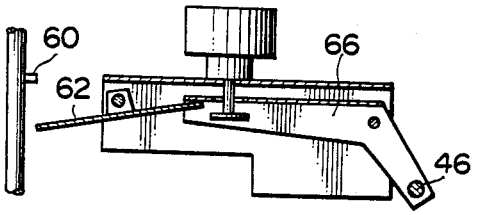

Then, when the wick 30 is ignited to cause the oil burner 10 to start combustion, a temperature of the oil burner 10 is gradually increased. This causes the thermally deformable element 56 to be deformed as indicated at phantom lines in FIG. 1, resulting in the projection 60 of the movable member 58 being upwardly moved while actuating the actuation member 62 or pivotally moving the member 62 in the clockwise direction in FIGS. 1 and 3, so that the projection 60 and actuation member 62 may be shifted from the position shown in FIG. 3A to that of FIG. 3C and the actuation member may be moved in the direction away from from the starting member 66. Thus, the abnormal combustion sensing and actuation mechanism 54 reaches such a position as indicated at phantom lines in FIG. 1. During the operation from FIG. 3A to FIG. 3C, the fire-extinguishing device 28 is kept stationary because the actuation member 62 does not actuate the starting member 66, so that the engagement between the gear 42 and the stopper 46 is not released. Also, during the combustion operation, as shown in FIG. 3C, the projection 60 fails to contact with the actuation member 62, because the locus of movement of the projection 60 is linear, whereas that of the actuation member 62 is arcuate. Thus, the actuation member 62 is at a position shown in Fig. 3C.

The manual fire-extinguishing is carried out by rotating the wick operating shaft 38 in the opposite direction, during which the engagement between the gear 42 and the stopper 46 is kept, to thereby keep the spring 44 at a wound-up state.

Figure 3D:
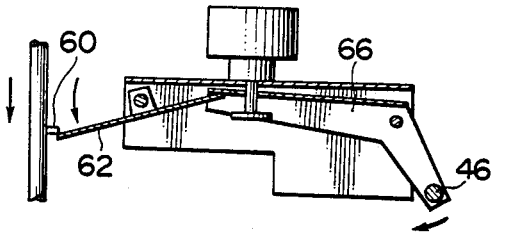

During the manual fire-extinguishing operation, the projection 60 is downwardly moved while pivotally moving the actuation member 62 in the counterclockwise direction as shown in FIG. 3D and finally returns to the position shown in FIG. 3A. During that, the actuation member 62 is rotated in the counterclockwise direction as described above, so that it may actuate the starting member 66 as shown in Fig. 3D, resulting in the stopper being actuated. This causes the gear 42 to be disengaged from the stopper 46 and reversely rotated by the wound-up return spring 44 to be returned to the original position. When the manual fire-extinguishing is carried out, the projection 60 and actuation member 62 are at the position shown in FIG. 3A; accordingly, the projection 60 fails to contact with the actuation member 62 when it is upwardly moved again for the purpose of ignition, because the member 62 has been pivotally moved in the direction separated from the projection 60 in arcs.

Now, the manner of fire-extinguishing operation due to the abnormal combustion will be described.

The procedures from the ignition to the combustion are substantially the same as described above.

When abnormal combustion occurs due to any cause such as a decrease in oxygen concentration in a room during the combustion operation to cause the oil burner to fall into an excessively decreased combustion state, the deformable element 56 deformed to downwardly move the movable member 58. This results in the projection 60 being shifted from a position shown FIG. 3C through that of Fig. 3D to that of FIG. 3A in the same manner as described above, during which the gear 42 is reversely rotated by the wound-up return spring 44, so that the wick operating shaft 38 may be reversely rotated. This results in the wick 30 being lowered to the original position to carry out the fire-extinguishing.

The oil burner may be ignited again by repeating the ignition procedures described above.

Figure 4:
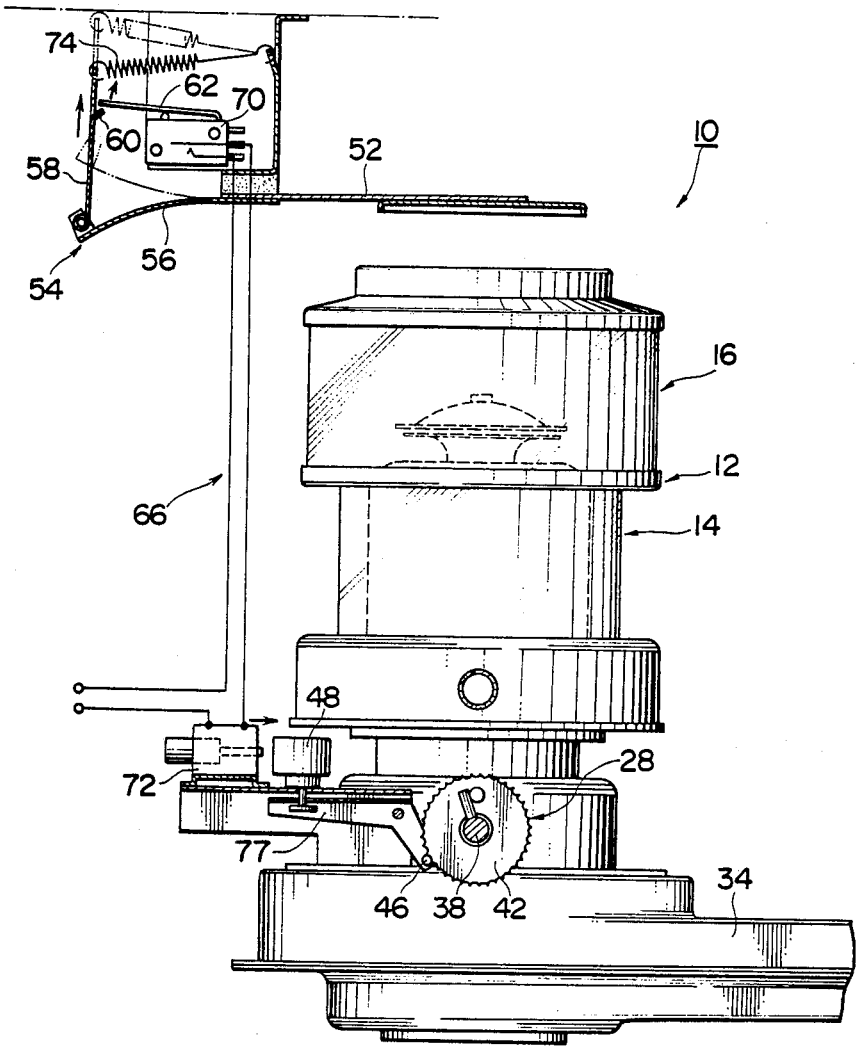
FIG. 4 is a front elevation view showing a modification of the embodiment shown in FIG. 1.

FIG. 4 shows a modification of the embodiment shown in FIG. 1. The modification shown in FIG. 4 is adapted to operate an automatic fire-extinguishing device 28 of an oil burner 10 through an electrically constructed starting means 66 when the abnormal combustion occurs. More particularly, in the modification, the starting means 66 comprises a micro switch 70 arranged above a combustion cylinder construction 12 and a solenoid 72 electrically connected to the micro switch 70 and arranged adjacent to a vibration sensing weight 48 to actuate the weight 48. An abnormal combustion sensing and actuation mechanism 54 further comprises a deformable element 56 arranged below the micro switch 70 and mechanically and thermally connected to a heat collecting means 52 arranged just above the combustion cylinder construction 12, a movable member 58 mounted on the deformable member 56 so as to upwardly extend therefrom and provided with a projection 60, and an actuation member 62 mounted on the micro switch 70 so as to be engaged with the projection 60 and operatedly connected to the micro witch 70. The heat collecting means 52 may comprise a plate member formed of a metal material into a suitable shape such as an annular shape, a circular shape or the like. Also, the modification shown in FIG. 4 is constructed in such a manner that a compression spring 74 is interposed between the movable member 58 and the heat collecting means 52 to constantly urge the movable member 58 toward the actuation member 62. The projection 60, as shown in FIG. 4, is preferably formed to upwardly obliquely extend from the movable member 58 toward the actuation member 62 for the purpose of ensuring the smooth engagement between the projection 60 and the actuation member 62.

Further, in the modification of FIG. 4, the actuation member 62 mounted on the micro switch 70 is regulated to carry out the pivotal movement at a small angle as compared with the embodiment of FIG. 1. More particularly. the pivotal movement of the actuation member 62 is limited to a range within which the member 62 is moved by the vertical movement of the movable member 58, so that when the movable member 58 upwardly moves to lift the actuation member 62, the projection 60 of the member 58 which is upwardly moved outwardly escapes from the actuation member 62 while moving along the member 62. This results in the movable member 58 being slightly rotated in the counterclockwise direction in FIG. 4 about the the lower end thereof against the compression spring 74. Then, the projection 60 is upwardly moved to a position above the actuation member 62 with the progress of combustion of the oil burner. When a combustion temperature of the oil burner is decreased, the movable member 58 is lowered, during which the projection 60 of the movable member 58 downwardly pushes the actuation member 62 to turn on the micro switch 70. The downward pivotal movement of the actuation member 62, as described above, is limited to such a position Accordingly, the projection 60 escapes from the actuation member 62 during the lowering of the movable member while moving along the member 62. This results in the movable member 58 being slightly rotated in the counterclockwise direction in FIG. 4 about the the lower end thereof against the compression spring 74. Then, the projection 60 is lowered to a position below the actuation member 62 with the downward movement of the movable member 58.

The remaining construction of the modification shown in FIG. 4 is substantially the same as the embodiment shown in FIG. 1.

In the modification shown in FIG. 4, when the ignition and combustion of the oil burner 10 is carried out to cause a temperature of the combustion cylinder construction 12 to be gradually increased, the deformable element 56 is deformed due to heat transmitted through the heat collecting plate member 52 thereto as indicated at phantom lines in FIG. 4, to thereby upwardly move the deformable member 56 and projection 60, resulting in the actuation member 62 being lifted. Then, the projection 60 is positioned above the actuation member 62 during the normal combustion of the oil burner. When abnormal combustion which forms an excessively decreased flame sufficient to generate incomplete combustion gas occurs in the oil burner, the deformable element 56 is cooled and deformed as indicated by solid lines in FIG. 4 to lower the projection 60 of the movable member 58, so that the projection may be engaged with the actuation member 62 to downwardly move the member 62. This causes the actuation member to actuate the micro switch 70 of the starting means 66, to thereby operate the fire-extinguishing device 28 through the solenoid 72.

Figure 5:
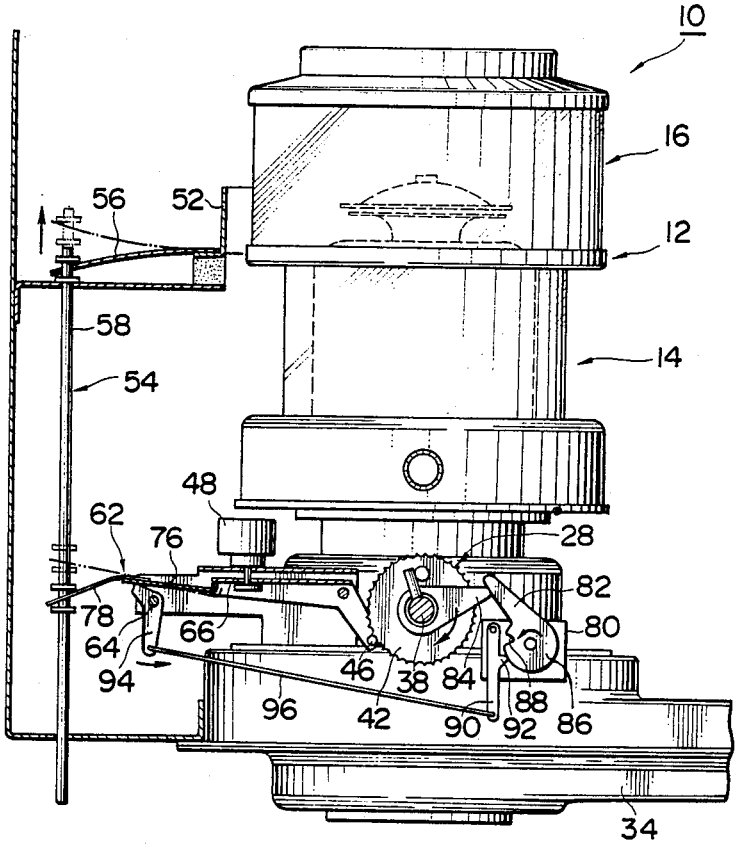
FIG. 5 is a front elevation view showing another embodiment of a safety device for an oil burner according to the present invention.

FIG. 5 shows another embodiment of a safety device for an oil burner according to the present invention.

In the embodiment of FIG. 5, a movable member 58 is connected directly to an actuation member 62, so that the vertical movement of the movable member 58 may pivotally move the actuation member 62 about a pin 64. Thus, the embodiment illustrated lacks an engagement means such as the projection 60 in the first embodiment. In the embodiment, the actuation member 62 comprises an actuation member body 76 selectively abutted against a starting means 66 and a leaf spring 78 mechanically connected to the actuation member body 76 and fittedly engaged directly with the movable member 58. An abnormal combustion sensing and actuation mechanism 54 also includes a timer 80 and a lever 82 for operating the timer which are mounted on an oil burner 10, and a cam plate 84 fitted on a wick operating shaft. The cam plate 84 acts to set the timer operating lever 82 at the wick lowering position of the wick operating shaft 38. The timer operating lever 82 is formed integral with a cam 86 for the timer 80, which is formed with a recess 88. Reference numeral 90 designates a lever which is pivotally mounted at one end thereof on the timer 80 and is provided with a projection 92 adapted to be engaged with the recess 88 of the timer cam 86.

On the pin 64 is also pivotally mounted a push lever 94 of which one end is adapted to be engaged with a lower surface of the actuation member body 76. Also, an abnormal combustion sensing and actuation mechanism 54 includes an actuation rod 96 connected between a lower end of the push lever 94 and a lower end of the lever 90. The push lever 94 serves to hold the actuation means 62 at a position separated from the the starting means 66 against the leaf spring 78 at the time of setting the timer 80.

Now, the manner of operation of the embodiment shown in FIG. 5 will be described hereinafter When the wick operating shaft 38 is rotated in the direction of raising a wick (not shown) and then the wick is ignited, the oil burner 10 starts combustion This causes the movable member 58 to be lifted to straighten the leaf spring 78 as indicated at phantom lines in FIG. 5, during which the cam plate 84 is moved in the direction separated from the timer operating lever 82 to actuate the timer 80. The illustrated embodiment is so constructed that even when the cam plate 84 is moved away from the timer operating lever 82, the timer is adapted to pivotally move the timer operating lever and timer cam in a predetermined period of time, accordingly, the actuation rod 96 is held at a pushed position for about ten to fifteen minutes until the mechanism 54 detects a high temperature. After about ten to fifteen minutes, the projection 92 of the lever 90 is fitted in the recess 88 of the timer cam 86 to rotate the push lever 94 in the counterclockwise direction.

Then, when the operation of the oil burner from combustion to fire-extinguishing is carried out by manually rotating the wick operating shaft 38, the cam plate 84 rotates the timer operating lever 82 in the clockwise direction to reset the lever 82. This releases the engagement between the recess 88 of the timer cam 86 and the projection 92 of the lever 90, so that the push lever 94 may be rotated in the clockwise direction through the actuation rod 96 to return to the position shown in FIG. 5.

Figure 6:
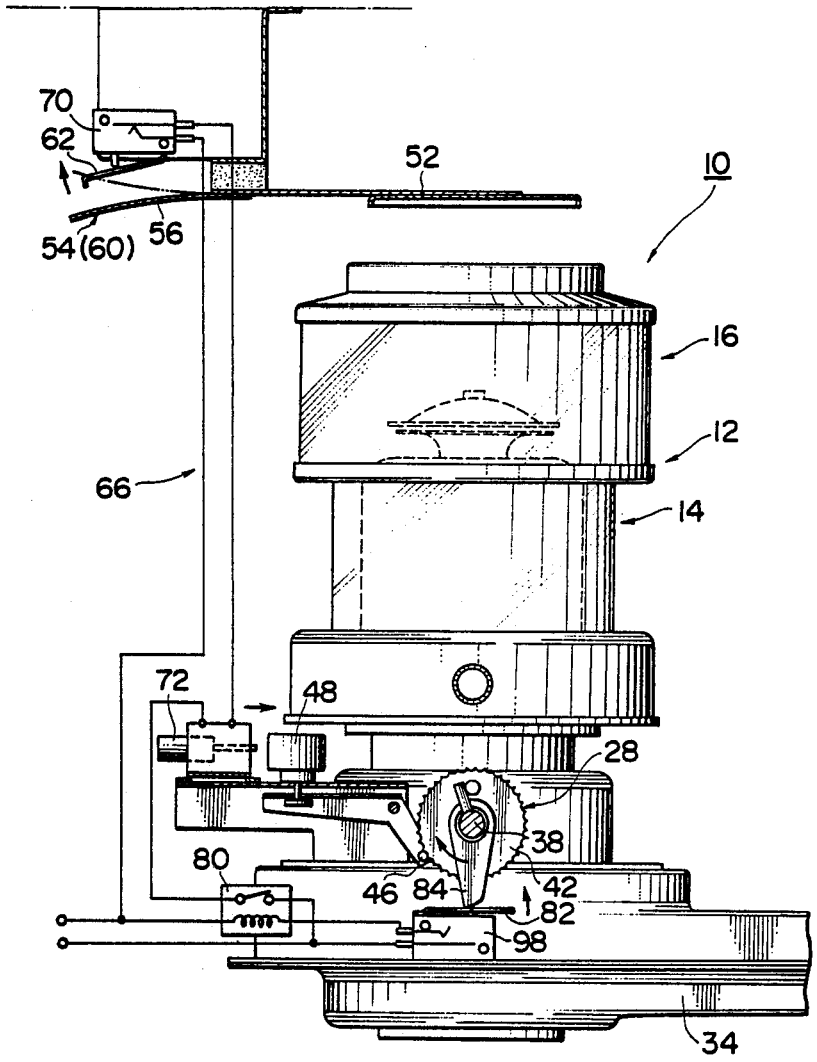
FIG. 6 is a front elevation view showing a modification of the embodiment shown in FIG. 5.

When abnormal combustion occurs during the normal combustion operation of the oil burner, the movable member 58 is lowered, during which the push lever 94 is kept at the position obtained due to the above-described counterclockwise rotation. Accordingly, the actuation member 62 is at a state separated from the push lever 94, so that the fire-extinguishing device starts. This results in the wick operating shaft 38 being rotated in the direction of lowering the wick. At this time, the push lever 94 is rotated in the clockwise direction to bend the leaf spring 78. embodiment shown FIG. 6 shows a modification of the embodiment shown in FIG. 5. The modification shown in FIG. 6 is adapted to operate an automatic fire-extinguishing device 28 through an electrically constructed starting means 66 when the abnormal combustion occurs, as in the modification shown in FIG. 4. More particularly. in the modification, the starting means 66 comprises a micro switch 70 arranged above a combustion cylinder construction 12 and a solenoid 72 electrically connected to the micro switch 70 and arranged adjacent to a vibration sensing weight 48 of a fire-extinguishing device 28 to actuate the weight 48. An abnormal combustion sensing and actuation mechanism 54 further comprises a heat collecting means 52 arranged just above the combustion cylinder construction 12, a deformable element 56 arranged below the micro switch 70 and mechanically and thermally connected to the heat collecting means 52, and an actuation member 62 mounted on a lower surface of the micro switch 70 so as to allow the deformable element 56 to be abutted against the actuation member 62 when the element 56 is deformed due to a variation in temperature. Thus, in the modification, it will be noted that the deformable element 56 also acts as a member corresponding to the movable member 58 in the embodiment described above. The heat collecting means 52 comprises a plate member formed of a metal material into a suitable shape such as an annular shape, a circular shape or the like. Also the modification is constructed in such a manner that a cam plate 84 of a wick operating shaft 38 turns off a timer switch 98 through a timer operating lever 82 at the wick lowering position of the wick operating shaft 38, to thereby open a contact of the timer 80, so that an electric circuit between the micro switch 70 and the solenoid 72 is opened to set a fire-extinguishing device 28. Also, in the modification, even when the cam plate 84 is separated from the timer switch 98 and a wick is ignited for the combustion operation of an oil burner 10, the timer 80 acts to feed an electric current to the micro switch 70 and solenoid 72 in a predetermined period of time. Thus, the electric circuit is kept at an interrupted state for ten to fifteen minutes until the mechanism 54 detects a high temperature sufficient to actuate the micro switch 70.

The remaining construction of the modification shown in FIG. 6 is substantially the same as the embodiment shown in FIG. 5.

In the modification shown in FIG. 6, when the ignition and combustion of an oil burner 10 is carried out to cause a temperature of the combustion cylinder construction 12 to be gradually increased, the deformable element 56 is deformed due to heat transmitted through the heat collecting plate member 52 thereto as indicated at phantom lines in FIG. 6 to be upwardly moved, resulting in being abutted against the actuation member 62. When abnormal combustion which forms an excessively decreased flame sufficient to generate incomplete combustion gas occurs in the oil burner, the deformable element 56 is cooled and deformed as indicated by solid lines in FIG. 6, to thereby be released from the engagement with the actuation member 62. This causes the actuation member 62 to actuate the micro switch 70 of the starting means 66, to thereby operate the fire-extinguishing device 28 through the solenoid 72.

The remaining operation of the modification shown in FIG. 6 is carried out in substantially the same manner as the embodiment of FIG. 5.

As can be seen from the foregoing, the embodiments described above each are capable of effectively detecting excessively decreased combustion due to, for example, the adhering of much tar to the wick, the excessive lowering of the wick, the clogging of an air rectifying plate and/or air filter with dust, the deficiency of air in a room or the like to cause the fire-extinguishing device to be automatically actuated. to thereby provide the oil burner with sufficiently improved safety Also, the above-described embodiments each are adapted to allow the fire-extinguishing device to be placed at a state to be reset when the fire-extinguishing is carried out, to thereby carry out in the operation of the oil burner with ease.

Figure 7:
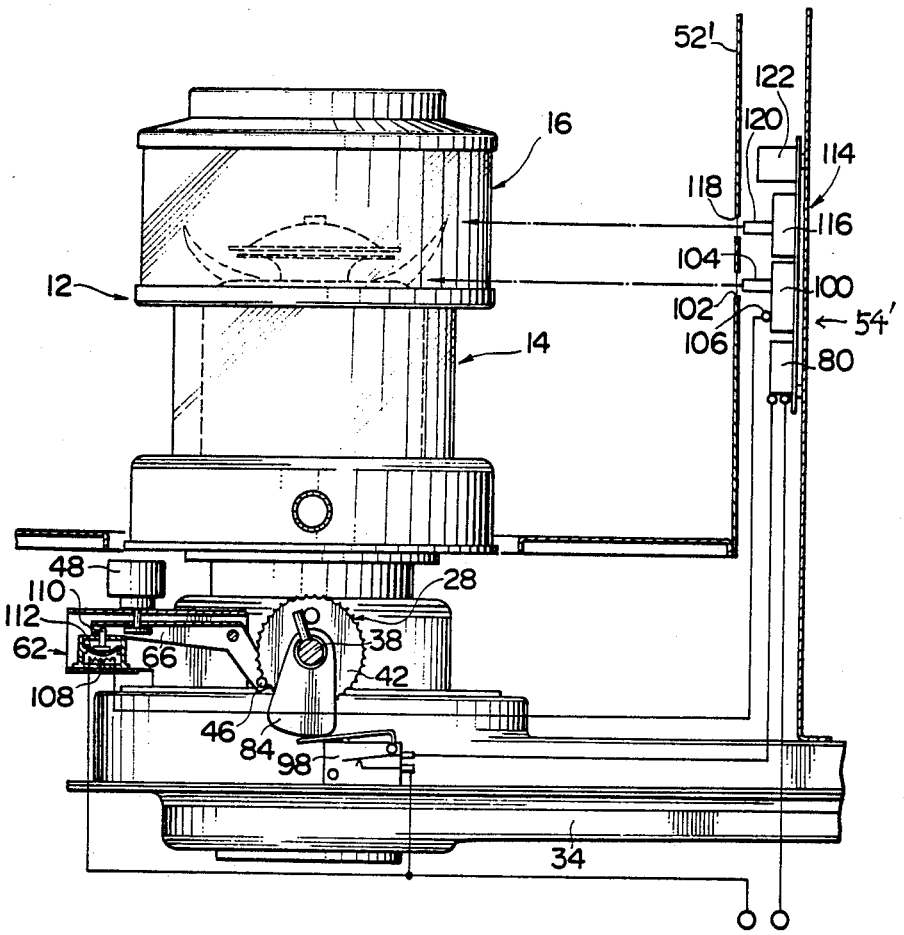
FIG. 7 is a front elevation view showing a further embodiment of a safety device for an oil burner according to the present invention.

FIG. 7 shows a further embodiment of a safety device for an oil burner according to the present invention. In a safety device of the illustrated embodiment an abnormal combustion sensing and actuation mechanism generally indicated by 54′ utilizes a heat ray sensing means which is generally designated by reference numeral 100.

More particularly, the safety device 50 of the illustrated embodiment may include a heat reflection plate 52′ arranged opposite to a combustion cylinder construction 12. The abnormal combustion sensing and actuation mechanism 54′ includes a heat ray sensing means 100 which, in the illustrated embodiment, is arranged behind the heat reflection plate 52′ and directly opposite to the combustion cylinder construction 12 through an opening 102 of the heat reflection plate 52′. In the illustrated embodiment, the sensing means 100 is arranged opposite to a red-heated cylinder section 14 of the combustion cylinder construction 12. The heat ray sensing means 100 has a guide tube 104 mounted on a front surface thereof which serves to specify a heat ray emitting position of the cylinder section 14.

The heat ray sensing means 100 serves to detect heat rays emitted from the red-heated cylinder and section 14 convert the so-detected heat rays into an electrical signal. The heat ray sensing means 100 also generates a heat ray non-detection signal while it does not detect heat rays and a heat ray detection signal while it detects heat rays. As a sensing element for the heat ray sensing means 100 is conveniently used an element which is capable of detecting visible rays as well as heat rays, such as a photoconductive cell including a phototransistor, a cadmium sulfide cell and the like. However, an element adapted to sense only heat rays may be used for the heat ray sensing means 100 as well.

The abnormal combustion sensing and actuation mechanism 54' also includes an actuation means 62 for starting a fire-extinguishing device 28 of the oil burner through a starting means 66, the actuation means 62 being adapted to be actuated by a signal supplied from the heat ray sensing means 100 through an output terminal 106 thereof. In the illustrated embodiment, the actuation means 62 comprises a heater 108 actuating when an electrical current (heat ray non-detection signal) is supplied thereto through the output terminal 106 of the heat ray sensing means 100, a projection 110, and a deformable member 112 formed of bimetal and adapted to be invertedly moved in one or two seconds to lift the projection 110 when it is heated by the heater 108. The actuation means 62 is adapted to lift one end of the starting means 66 through the projection 110 to actuate when the projection is pushed up, to thereby operate the fire-extinguishing device 28.

The abnormal combustion sensing and actuation mechanism 54' also includes a cam plate 84 fitted on a wick operating shaft 38 of the fire-extinguishing device 28, the cam plate 84 serving to turn off a main switch 98 for controlling the start of a timer 80 described hereinafter when the wick operating shaft 38 is at a wick lowering position. The main switch 98 is turned on when the wick operating shaft is rotated to a wick ignition position shown in FIG. 7.

The embodiment shown in FIG. 7 may be constructed to include a second abnormal combustion sensing and actuation mechanism 114 which is adapted to detect abnormal combustion which forms an excessively increased flame which is in danger of, for example, overheating of the oil burner and/or a fire. The second mechanism 114 includes a second heat ray sensing means 116 which has a sensing element arranged opposite to the combustion cylinder construction 12 through an opening of the heat reflection plate 52'. In the illustrated embodiment, the second heat ray sensing means 116 is arranged above the first heat ray sensing means 100 and opposite to a flame spreading section 16. The second heat ray sensing means 116 also has a guide tube 120 mounted on a front surface thereof which serves to specify a heat ray emitting position of the flame spreading section 16. The second heat ray sensing means 116 is to detect a height of a flame formed at the flame spreading section, thus, it preferably has precision higher than the first one 100. However, heat rays which have been incident into the guide tube 120 in a manner to be oblique with respect to an opening of the tube 120 is apt to cause malfunction of the senser 116, because the heat rays reach the senser 116 while reflecting on an inner surface of the tube 120. Particularly, a top of the flame exhibits high luminance. Accordingly, the guide tube 120 is desirably formed to have a small diameter.

The second heat ray sensing means 116 is adapted to detect heat rays emitted from a flame formed at the flame spreading section 16 to generate a heat ray detection signal for actuating the actuation means 62, when the flame is excessively increased to a degree sufficient to reach a predetermined position. The second heat ray sensing means 116 is electrically connected to the actuation means 62 by means of a connecting wire means (not shown) as in the first heat ray sensing means 100.

The second abnormal combustion sensing and actuation mechanism 114 also may include an alarm 122 such as a buzzer or the like, which is adapted to be actuated when a heat ray detection signal is generated from the second heat ray sensing means 116. The alarm 122 may be constructed in any desired manner. For example, it may be so constructed that it is actuated in a predetermined period of time before the actuation means 62 is actuated, to thereby call a user's attention. Such construction allows the manual adjustment of combustion due to the wick lowering operation to be effectively carried out before the automatic fire-extinguishing operation is carried out through the actuation means 62, when an operator is near the oil burner.

Figure 8:
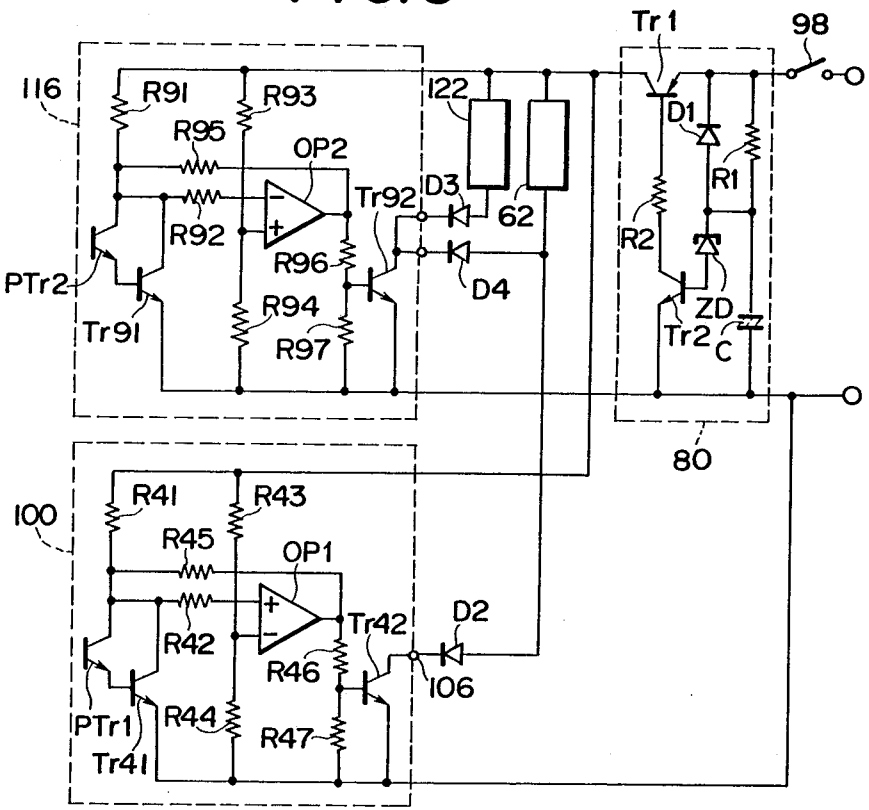

FIG. 8 shows one example of an electric circuit which may be employed in the embodiment of FIG. 7 in relation to the first and second abnormal combustion sensing and actuation mechanisms 54' and 114. In FIG. 8, the turning-on of the main switch 98 causes the timer 80 to be connected to a power source (not shown). The timer 80 used in the illustrated embodiment is a CR timer in which a capacitor and resistors are used. More particularly, the timer 80 comprises a series circuit comprising a resistor R1 and a capacitor C connected in parallel to an output terminal of the power source (not shown), a diode D1, a Zener diode ZD of which a cathode is connected to a connection between the resistor R1 and the capacitor C, a transistor Tr1 of which a cathode-emitter circuit is connected in series to the switch 98, a resistor R2 of which one end is connected to a base of the transistor Tr1, and a transistor Tr2 of which a collector is connected to the other end of the resistor R2, a base is connected to an anode of the Zener diode ZD and an emitter is grounded.

Now, the manner of operation of the timer 80 will be described hereinafter.

When the switch 98 is closed, the capacitor C is charged through the resistor R1; so that when a voltage across the capacitor C reaches a Zener level of the Zener diode ZD, the transistor Tr2 is turned on. This results in the transistor Tr1 being turned on. Accordingly, when a time interval depending upon a time constant determined by the resistor R1 and capacitor C elapses, the timer 80 feeds an output of the power source (not shown) therethrough to the first and second heat ray sensing means 100 and 116, the actuation means 62, and the alarm 122. The timer 80 is determined to have a time interval longer than a time required from ignition to the generation of heat rays of a predetermined intensity at the portion of the combustion cylinder construction to which the first heat ray sensing means 100 is arranged opposite.

The first heat ray sensing means 100 includes a phototransistor PTr1 serving as an element for detecting heat rays emitted from the combustion cylinder construction 12. The phototransistor PTr1 is connected through a resistor R41 to a collector of the transistor Tr1 of the timer 80. Also, a collector-emitter circuit of the phototransistor PTr1 is connected in parallel to a basecollector circuit of a transistor Tr41 for amplification. A collector of the transistor Tr41 is connected through a resistor R42 to a positive terminal of an operational amplifier OP1 acting as a comparator. To a negative terminal of the operational amplifier OP1 is connected the connection between a resistor R43 and a resistor R44. A series circuit comprising the resistors R43 and R44 constitutes a reference voltage generating circuit which serves to generate a reference voltage for carrying out distinction between heat rays to be detected and disturbance light which enter a base of the phototransistor PTr1. The so-generated reference voltage is determined to have a value larger than a detection voltage supplied to the positive terminal of the operational amplifier OP1 when only disturbance light enters the phototransistor and smaller than a detection voltage supplied to the positive terminal when heat rays enter it.

An output of the operational amplifier OP1 is decreased to a low level or a ground level when an input voltage supplied to the positive terminal is equal to or above the reference voltage fed to the negative terminal and increased to a high level when the input voltage is lower than the reference voltage. For example, when the phototransistor PTr1 fails to detect heat rays emitted from the red-heated cylinder section 14 or excessively decreased combustion sufficient to generate incomplete combustion gas is carried out, the voltage input to the positive terminal of the operational amplifier OP1 is decreased below the reference voltage. This causes an electric current to flow from the power source through the resistors R45, R46 and R47, so that a current may flow through a base of a transistor Tr42 to turn on the transistor Tr42. At this time, when the transistor Tr1 of the timer 80 is turned on, a current flows from the power source through the heater 108 of the actuation means 62 (FIG. 7), a diode D2 and the output terminal 106 of the heat ray sensing means 100 to actuate the actuation means 62 for a period of time during which the transistor Tr42 is turned on.

Also, when the phototransistor PTr1 detects heat rays, the voltage supplied to the positive terminal is decreased above the reference voltage. This causes an output of the operational amplifier OP1 to be at a ground level to turn off the transistor Tr42, so that the actuation means 62 may not be actuated.

The second heat ray sensing means 116 is constructed in substantially the same manner as the first one 100 except for that the manner of input to positive and negative terminals of an operational amplifier OP2 is opposite to that in the operational amplifier OP1 and an output of the operational amplifier OP2 is opposite to that of the operational amplifier OP1. In the illustrated embodiment, when a combustion flame formed at the flame spreading section 16 excessively or abnormally increased during the combustion operation of the oil burner 10, a phototransistor PTr2 of the second heat ray sensing means 116 is turned on to cause an input voltage fed to a negative terminal of the operational amplifier OP2 to be increased above a reference voltage fed to a positive terminal of the operational amplifier OP2. This results in an output of the operational amplifier OP2 being increased to a high level sufficient to turn on a transistor Tr92, so that a current may flow from the alarm 122 and actuation means 62 through diodes D3 and D4. Thus, when the actuation means 62 is actuated, the fire-extinguishing device 28 may be operated through the starting means 66 to stop the abnormal combustion.

In the illustrated embodiment, even when the main switch 98 is closed due to the cam plate 84 at the time of ignition, the heat ray sensing means 100 and 116, actuation means 62, and alarm 122 are electrically isolated from the power source unless the timer 80 counts a predetermined time period or interval. Accordingly, even when a temperature of the combustion cylinder construction 12 remains low because immediately after ignition the combustion is not sufficient to cause the heat ray sensing means 100 to detect heat rays, the fire-extinguishing is not operated because the heat ray sensing means 100 is kept at a non-operation state. Also, when the oil burner fails to reach normal combustion although the ignition is carried out, a temperature of the combustion cylinder construction 12 is kept low even after the timer 80 completes the counting operation. This causes the heat ray sensing means 100 which has reached an operable state to generate a signal from the output terminal 106, so that the actuation means 62 may be actuated to operate the fire-extinguishing device 28 through the starting means 66.

Figure 9:
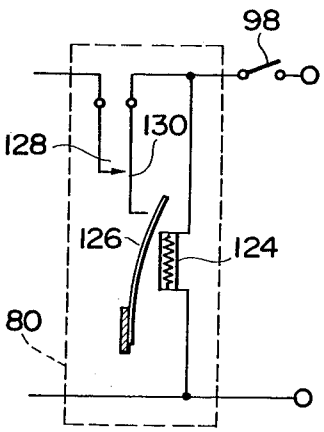
FIGS. 8 and 9 each are a circuit diagram showing an electric circuit which is adapted to be employed in the embodiment shown in FIG. 7.

FIG. 9 is a circuit diagram showing a modification of the timer 80. In a timer 80 shown in FIG. 9, when the main switch 98 is closed, a current flows through a heating element 124 comprising a resistor, so that the heating element 124 may heat bimetal 126 arranged adjacent thereto. The so-heated bimetal straightly extends in a few minutes to contact a movable contact 130 with a fixed contact 128, to thereby connect the heat ray sensing means 100 and 116 to the power source. Thus, it will be noted that the timer 80 of FIG. 9 is a bimetal timer in which the bimetal 126 is adapted to determine a time interval.

The heat ray sensing means 100 and 116 each may include a filter which is capable of passing only light of a predetermined wavelength therethrough to detect only heat rays.

Thus, the embodiment shown in FIG. 7 as well as the embodiments shown in FIGS. 1 to 6 is capable of effectively detecting excessively decreased combustion forming incomplete combustion gas such as carbon monoxide due to the adhesion of much tar to the wick, the excessive lowering of the wick in the combustion operation, the clogging of an air rectifying plate or air filter with dust, the deficiency of oxygen in a room to automatically operate the fire-extinguishing device, so that the oil burner may be provided with highly improved safety.

Also, the embodiment is constructed to utilize heat rays for detecting abnormal combustion in the oil burner. This allows the heat ray sensing means to be arranged at any desired position so long as it can detect heat rays, to thereby simplify the structure of the oil burner.

Furthermore, the embodiment is capable of detecting both abnormal combustion forming an excessively decreased flame and that forming an excessively increased flame, because the detection of heat rays provides an oil burner with a place sufficient to allow the heat ray sensing means detecting excessively decreased combustion, as well as that detecting excessively increased combustion, to be arranged.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A safety device for an oil burner comprising:

an abnormal combustion sensing and actuation mechanism arranged to receive heat rays emitted from a combustion cylinder construction of said oil burner to detect abnormal combustion which occurs in said oil burner after a normal combustion forming a combustion flame emitting heat rays of at least a predetermined intensity and which forms an excessively decreased flame sufficient to produce incomplete combustion gas; and, a starting means for starting a fire-extinguishing device of said oil burner, said starting means being operatedly connected to said abnormal combustion sensing and actuation mechanism so as to be actuated to operate said fire-extinguishing device when said abnormal combustion sensing and actuation mechanism detects said abnormal combustion occuring after said normal combustion, said abnormal combustion sensing and actuation mechanism including means for preventing said actuation of the starting means for a period of time after ignition of the oil burner sufficient to provide said normal combustion.

2. A safety device for an oil burner comprising:

an abnormal combustion sensing and actuation mechanism arranged to receive heat rays emitted from a combustion cylinder construction of said oil burner, said abnormal combustion sensing and actuation mechanism carrying out mechanical actuation when it detects, due to a variation in a temperature of said combustion cylinder construction, abnormal combustion which occurs in said combustion cylinder construction after a normal combustion forming a combustion flame emitting heat rays of at least a predetermined intensity and which forms an excessively decreased flame sufficient to produce incomplete combustion gas; and, a starting means for starting a fire-extinguishsing device of said oil burner, said starting means being operatedly connected to said abnormal combustion sensing and actuation mechanism so as to be actuated to start said fire-extinguishing device when said abnormal combustion sensing and actuation mechanism detects said abnormal combustion occurring after said normal combustion, said abnormal combustion sensing and actuation mechanism including means for preventing said actuation of the starting means for a period of time ignition of the oil burner sufficient to provide said normal combustion.

3. A safety device as defined in claim 2 wherein said abnormal combustion sensing and actuation mechanism comprises:

a movable means moved due to a variation in a temperature of a combustion cylinder construction of said oil burner; and, an actuation means operatedly connected to said movable means so as to be selectively actuated by said movable means;

said starting means being operatedly connected between said actuation means and said fire-extinguishing device of said oil burner so as to operate said fire-extinguishing device when it is actuated by said actuation means, said movable means separating said actuation means from said starting means when a temperature of said combustion cylinder construction is increased and actuating said actuation means to operate said fire-extinguishing device through said starting means when a temperature of said combustion cylinder construction is decreased, and said movable means being at a position sufficient to be disengaged from said actuation means when fire-extinguishing of said oil burner is carried out or while combustion operation of said oil burner is carried out.

4. A safety device as defined in claim 3, wherein said movable means comprises a thermally deformable element deformed due to a variation in a temperature of said combustion cylinder construction and a movable member mechanically connected to said thermally deformable element so as to be moved upon deformation of said thermally deformable element and operatedly connected to said actuation means.

5. A safety device as defined in claim 4 further comprising a heat collecting means arranged to receive heat rays emitted from said combustion cylinder construction of said oil burner; wherein said thermally deformable element is thermally and mechanically connected to said heat collecting means.

6. A safety device as defined in claim 4, wherein said starting means comprises an extension of a stopper of said fire-extinguishing device.

7. A safety device as defined in claim 3, wherein said starting means comprises a micro switch selectively actuated by said actuation means and a solenoid electrically connected to said micro switch, said solenoid operating said fire-extinguishing device when it is actuated by said micro switch.

8. A safety device as defined in claim 7, wherein said solenoid operates said fire-extinguishing device through a vibration sensing weight of said fire-extinguishing device.

9. A safety device as defined in claim 6, wherein said movable member is provided with an engagement projection through which said actuation means is operatedly connected to said movable member.

10. A safety device as defined in claim 2 wherein said abnormal combustion sensing and actuation mechanism comprises:

a movable means moved due to a variation in a temperature of a combustion cylinder construction of said oil burner;

an actuation means operatedly connected to said movable means so as to be selectively actuated by said movable means; and, a timer means actuated at the time of ignition of said oil burner;

said starting means being operatedy connected between said actuation means and said fire-extinguishing device of said oil burner to operate said fire-extinguishing device when it is actuated by said actuation means, said movable means placing said actuation means in a non-actuation state when a temperature of said combustion cylinder construction is increased and actuating said actuation means to operate said fire-extinguishing device through said starting means when a temperature of said combustion cylinder construction is decreased or the fire-extinguishing is carried out, and said timer means being operatedly connected to said fire-extinguishing device so as to place said fire-extinguishing device in an operation state after a predetermined period of time form ignition of said oil burner.

11. A safety device as defined in claim 10, wherein said starting means comprises an extension of a stopper of said fire-extinguishing device, said timer means being operatedly connected through said actuation means and starting means to said fire-extinguishing device.

12. A safety device as defined in claim 10, wherein said starting means comprises a micro switch actuated by said actuation means and a solenoid electrically connected to said micro switch to operate said fire-extinguishing device when it is actuated by said micro switch;

said timer means being connected to an electric circuit of said micro switch and solenoid.

13. A safety device as defined in claim 10, wherein said movable means comprises a thermally deformable element deformed due to a variation in a temperature of said combustion cylinder construction and a movable member mechanically connected to said thermally deformable element to be moved upon deformation of said thermally deformable element and operatedly connected to said actuation means.

14. A safety device as defined in claim 13 further comprising a heat collecting means arranged to receive heat rays emitted from said combustion cylinder construction of said oil burner; wherein said thermally deformable element is thermally and mechanically connected to said heat collecting means.

15. A safety device as defined in claim 10, wherein said movable means comprises a thermally deformable element which moves upon its deformation due to a variation in a temperature of said combustion cylinder construction.

16. A safety device as defined in claim 15 further comprising a heat collecting means arranged to receive heat rays emitted from a combustion cylinder construction of said oil burner; wherein said thermally deformable element is thermally and mechanically connected to said heat collecting means.

17. A safety device for an oil burner comprising' an abnormal combustion sensing and actuation mechanism arranged to receive heat rays emitted from a combustion cylinder construction of said oil burner, said abnormal combustion sensing and actuation mechanism carrying out its actuation when it electrically detects, due to a variation in heat rays emitted from..said combustion cylinder construction, abnormal combustion within said combustion cylinder construction which forms an excessively decreased flame sufficient to produce incomplete combustion gas; and a starting means operatedly connected between said abnormal combustion sensing and actuation mechanism and a fire-extinguishing device of said oil burner, said starting means being actuated to start said fire-extinguishing device when said abnormal combustion sensing actuation means detects said abnormal combustion of said oil burner.

18. A safety device for an oil burner comprising:

a heat ray sensing means for electrically detecting heat rays emitted from a combustion cylinder construction of said oil burner and generating a heat ray non-detection signal while it does not detect the heat rays;

an actuation means actuated by said non-detection signal generated from said heat ray sensing means;

a starting means operatedly connected between said actuation means and a fire-extinguishing device of said oil burner, said starting means operating said fire-extinguishing device when said non-detection signal is supplied to said actuation means; and a timer means for starting the counting of a predetermined time interval when ignition operation of said oil burner is carried out and operating said heat ray sensing means when the counting of said predetermined time interval is completed.

19. A safety device as defined in claim 18, wherein said timer means is electrically connected between a power source and said heat ray sensing means, said timer means keeping said heat ray sensing means at a state interrupted from said power source while it counts said predetermined time interval.

20. A safety device as defined in claim 19, wherein said timer means includes a capacitor charged through a resistor when a main switch is closed for ignition of said oil burner and a switch means turned off to interrupt said heat ray sensing means from said power source until a voltage across said capacitor reaches a predetermined level.

21. A safety device as defined in claim 19, wherein said timer means comprises a heating means actuated when a main switch is closed for ignition of said oil burner;

a bimetal deformed due to heat generated from said heating means;

switches keeping said heat ray sensing means at a state interrupted from said power source until said switches are closed due to deformation of said bimetal.

22. A safety device as defined in claim 18, wherein said heat ray sensing means comprises a sensing element for generating a detection voltage proportional to the intensity of heat rays incident thereto;

a reference voltage generating means for generating a reference voltage smaller than a detection voltage generated from said detection element when heat rays are incident into said detection element and larger than a detection voltage generated from said detection element when visible rays other than said heat rays are incident into said detection element; and a comparator means for carrying out the comparison between said detection voltage generated from said detection element and said reference voltage;

said heat ray non-detection signal being generated when said detection voltage is smaller than said reference voltage.

23. A safety device as defined in claim 18 further comprising a second heat ray sensing means arranged to receive heat rays emitted from said combustion cylinder construction, said second heat ray sensing means detecting heat rays emitted from an excessively increased combustion flame exceeding a predetermined level formed at said combustion cylinder construction to generate a heat ray detection signal therefrom during the formation of said excessive combustion flame; wherein said actuation means also is actuated by said heat ray detection signal generated from said second heat ray sensing means to operate said fire-extinguishing device; and said timer means is electrically connected to said second heat ray sensing means and keeps it at a nonactuation state until it completes the counting of said predetermined time interval.

24. A safety device as defined in claim 23 further comprising an alarm means connected to said second heat ray sensing means and actuated when said second heat ray sensing means generates said heat ray detection signal.

25. A safety device as defined in claim 23, wherein said heat ray sensing means is arranged to receive heat rays emitted from a red-heated cylinder section of said combustion cylinder construction and said second heat ray sensing means is arranged to receive heat rays emitted from a flame spreading section of said combustion cylinder construction.

26. A safety device as defined in claim 25, wherein said second heat ray sensing means receives said heat rays through a guide tube, said guide tube of said second heat ray sensing means being formed to have a small diameter.

27. A safety device as defined in claim 25, wherein said heat ray sensing means and second heat ray sensing means receive said heat rays through guide tubes, respectively, said guide tube of said second heat ray sensing means being formed to have a small diameter.

28. A safety device as defined in claim 23 further comprising a heat reflection means arranged opposite to said combustion cylinder construction; wherein said heat ray sensing means and second heat ray sensing means each are arranged to receive said heat rays through an opening of said heat reflection means.

29. A safety device as defined in claim 2 wherein said abnormal combustion sensing and actuation mechanism comprises:

a heat collecting plate member arranged to receive heat rays from a combustion cylinder construction of said oil burner;

a thermally deformable element thermally and mechanically connected to said heat collecting plate member;

a movable member mounted on said thermally deformable element to be vertically moved due to deformation of said thermally deformable element and provided with a projection; and an actuation member pivotally movably arranged and operatedly connected to said movable member through said projection;

said starting member being operatedly connected between said actuation member and said fire-extinguishing device of said oil burner and comprising an extension of a stopper of said fire-extinguishing device, said movable member being upwardly moved due to deformation of said thermally deformable element to separate said actuation member from said starting member when a temperature of said combustion cylinder construction is increased and downwardly moved to pivotally move said actuation member through said projection to operate said fire-extinguishing device through said starting member when a temperature of said combustion cylinder construction is decreased, and said movable member being at a position sufficient to be disengaged from said actuation member when fire-extinguishing of said oil burner is carried out or while combustion operation of said oil burner takes place.

30. A safety device as defined in claim 2 wherein said abnormal combustion sensing and actuation mechanism comprises:

a heat collecting plate member arranged to receive heat rays from a combustion cylinder construction of said oil burner;

a thermally deformable element thermally and mechanically connected to said heat collecting plate member;

a movable member mounted on said thermally deformable element to be vertically moved due to deformation of said thermally deformable element and provided with a projection;

an actuation member pivotally movably arranged and operatedly connected to said movable member through said projection, said actuation member being constantly biased with respect to said movable member; and, a micro switch selectively actuated by said actuation member and a solenoid electrically connected to said micro switch, said solenoid actuating a vibration sensing weight of said fire-extinguishing device of said oil burner to operate said fire-extinguishing device when it is actuated by said micro switch;

said movable member being upwardly moved due to deformation of said thermally deformable element to separate said actuation member from said micro switch when a temperature of said combustion cylinder construction is increased and downwardly moved to pivotally move said actuation member through said projection to actuate said micro switch to operate said fire-extinguishing device through said solenoid and vibration sensing weight when a temperature of said combustion cylinder construction is decreased, and said movable member being at a position sufficient to be disengaged from said actuation member when fire-extinguishing of said oil burner is carried out or while combustion operation of said oil burner takes place.

31. A safety device as defined in claim 2 wherein said abnormal combustion sensing and actuation mechanism comprises:

a heat collecting plate member arranged to receive heat rays emitted from a combustion cylinder construction of said oil burner;

a thermally deformable element thermally and mechanically connected to said heat collecting plate member;

a movable member mounted on said deformable element to be vertically moved due to deformation of said thermally deformable element;

an actuation member comprising an actuation member body and a leaf spring mounted at one end thereof on said actuation member body and connected at the other end thereof directly to said movable member; and, a timer actuated upon ignition of said oil burner;

said starting means comprising an extension of a stopper of said fire-extinguishing device of said oil burner and being operatedly connected to said actuation member body to operate said fire-extinguishing device when it is actuated by said actuation member, said movable member placing said actuation member in a non-actuation state when a temperature of said combustion cylinder construction is increased and actuating said actuation member to operate said fire-extinguishing device through said starting member when a temperature of said combustion cylinder construction is lowered or the fire-extinguishing is carried out, and said timer being mechanically connected to said fire-extinguishing device through said actuation member and starting member so as to place said fire-extinguishing device in an operation state after a predetermined period of time from the ignition of said oil burner.

32. A safety device as defined in claim 2 wherein said abnormal combustion sensing and actuation mechanism comprises:

a thermally deformable element thermally and mechanically connected to said heat collecting plate member and deformed and moved due to a variation in a temperature of said combustion cylinder construction;

an actuation member pivotally movably arranged and actuated due to the movement of said thermally deformable element.

a micro switch selectively actuated by said actuation member and a solenoid electrically connected to said micro switch, said solenoid operatedly connected to a vibration sensing weight of said fire-extinguishing device of said oil burner to operate said fire-extinguishing device through said vibration sensing weight when it is actuated by said micro switch; and, a timer actuated upon ignition of said oil burner;

said thermally deformable element placing said actuation member in a non-actuation state when a temperature of said combustion cylinder construction is increased and actuating said actuation member to actuate said solenoid through said micro switch to operate said fire-extinguishing device through said vibration sensing weight when a temperature of said combustion cylinder construction is decreased or the fire-extinguishing is carried out, and said timer being operatedly connected through an electric circuit of said micro switch and solenoid to said fire-extinguishing device so as to place said fire-extinguishing device in an operation state after a predetermined period of time from the ignition of said oil burner.

33. A safety device for an oil burner comprising:

a heat ray sensing means for electrically detecting heat rays emitted from a combustion cylinder construction and generating a heat ray non-detection signal while it does not detect the heat rays;

an actuation means electrically connected to said heat ray sensing means and actuated by said non-detection signal generated therefrom;

a starting member comprising an extension of a stopper of a fire-extinguishing device of said oil burner and operatedly connected to said actuation means to operate said fire-extinguishing device therethrough when said non-detection signal is supplied to said actuation means; and a timer for starting the counting of a predetermined time interval upon ignition of said oil burner and actuating said heat ray sensing means when the counting of said predetermined time interval is completed, said timer being connected between a power source and said heat ray sensing means and keeping said heat ray sensing means at a state interrupted from said power source while it counts said predetermined time interval.

34. A safety device for an oil burner comprising a first heat ray sensing means for electrically detecting heat rays emitted from a red-heated cylinder section of a combustion cylinder construction and generating a heat ray non-detection signal while it does not detect the heat rays;

a second heat ray sensing means for electrically detecting heat rays emitted from an excessively increased combustion flame exceeding a predetermined level formed at a flame spreading section of said combustion cylinder construction to generate a heat ray detection signal therefrom during the formation of said excessively increased combustion flame;

an actuation means electrically connected to said first and second heat ray sensing means and actuated by said non-detection signal and heat ray detection signal generated therefrom;

a starting member comprising an extension of a stopper of a fire-extinguishing device of said oil burner and operatedly connected to said actuation means to operate said fire-extinguishing device therethrough when said non-detection signal and/or heat ray detection signal are supplied to said actuation means;

a timer for starting the counting of a predetermined time interval upon ignition of said oil burner and operating said first and second heat ray sensing means when the counting of said predetermined time interval is completed, said timer being connected between a power source and said first and second heat ray sensing means and keeping said first and second heat ray sensing means at a state interrupted from said power source while it counts said predetermined time interval;

and an alarm electrically connected to said second heat ray sensing means so as to be actuated when said heat ray detection signal is generated from said second heat ray sensing means.

35. A safety device as defined in claim 1, wherein said abnormal combustion sensing and actuation mechanism further includes a heat responsive means positioned outside of said oil burner for receiving heat rays emitted from said combustion cylinder construction to the exterior of said oil burner.

* * * * *

UNITED STATES PATENT AND TRADEMARK OFFICE

CERTIFICATE OF CORRECTION

PATENT NO. : 4,797,088

DATED : January 10, 1989

INVENTOR(S) : Nakamura, et al.

It is certified that error appears in the above-identified patent and that said Letters Patent is hereby corrected as shown below:

Column 16, line 44, change "operatedy" to --operatedly--.

Column 16, line 60, change "form" to --from--.

Column 17, line 41, delete "..".

Column 17, line 34, "comprising'" should read --comprising:--.

Signed and Sealed this

Thirteenth Day of June, 1989

*Attest:*

DONALD J. QUIGG

*Attesting Officer*

*Commissioner of Patents and Trademarks*